United States Patent [19]

Atkins

[11] 4,369,572

[45] Jan. 25, 1983

[54] METHODS OF MAKING ELECTRICAL CONNECTORS

[75] Inventor: Sidney H. Atkins, Towcester, England

[73] Assignee: Plessey Overseas Limited, Essex, England

[21] Appl. No.: 180,869

[22] Filed: Aug. 25, 1980

[30] Foreign Application Priority Data

Aug. 31, 1979 [GB] United Kingdom ..... 7930351

[51] Int. Cl.[3] ..... H01R 43/02

[52] U.S. Cl. ..... 29/879; 29/876; 339/276 SF

[58] Field of Search ..... 228/159, 160, 180 A; 29/747, 884, 885, 755, 876, 877, 879; 339/276 SF

[56] References Cited

U.S. PATENT DOCUMENTS

| | | | |
|---|---|---|---|
| 3,516,157 | 6/1970 | Brown | 29/884 |
| 3,618,207 | 11/1971 | Sand et al. | 29/884 X |
| 3,660,632 | 5/1972 | Leinkram | 228/180 A X |
| 3,864,008 | 2/1975 | Bakermans et al. | 339/276 SF X |
| 4,045,869 | 9/1977 | Hartmann et al. | 29/884 |
| 4,265,508 | 5/1981 | Chisholm | 339/276 SF X |

FOREIGN PATENT DOCUMENTS

| | | | |
|---|---|---|---|
| 2348674 | 9/1973 | Fed. Rep. of Germany | 339/276 SF |
| 1375854 | 11/1974 | United Kingdom | 339/276 SF |
| 1539599 | 1/1979 | United Kingdom . | |

*Primary Examiner*—Francis S. Husar
*Assistant Examiner*—Carl J. Arbes
*Attorney, Agent, or Firm*—Fleit & Jacobson

[57] ABSTRACT

A method of making electrical connectors comprises the steps of producing a carrier strip having a plurality of contact portions and a plurality of retaining lugs formed thereon, locating a contact leg on the carrier strip in a retaining lug substantially in line with each contact portion, welding the contact leg to the carrier strip and cutting portion of the carrier strip whereby the contact portion is severed from the carrier strip and is retained on the contact leg.

6 Claims, 2 Drawing Figures

METHODS OF MAKING ELECTRICAL CONNECTORS

This invention relates to methods of making electrical connectors.

According to the present invention a method of making electrical connectors comprises the steps of producing an elongate carrier strip having a plurality of contact portions formed thereon, locating a contact leg on the carrier strip substantially in line with each contact portion, welding the contact leg to the carrier strip and cutting the carrier strip in a predetermined manner whereby the contact portion is severed from the carrier strip and is retained on the contact leg by the weld.

Preferably retaining means are provided on the remains of the carrier strip whereby each contact portion and its associated contact leg are retained on the remains of the carrier strip which then becomes a connector holding strip.

Preferably the carrier strip with the contact portions is substantially planar in construction. The contact portions preferably comprise elongate members extending perpendicularly from one side of the carrier strip, but may be formed with contact portions extending from both sides of the axis of the carrier strip, the carrier strip being separated into two strips along its central axis before the contact leg welding step.

Preferably the retaining means comprises at least one retaining lug formed on the carrier strip adjacent to each contact portion. The carrier strip is preferably formed by a pressing operation.

The invention also comprises an electrical connector made by the method as described hereinbefore.

The invention also comprises a carrier strip having a plurality of contact portions with contact legs welded thereon and cut in a predetermined manner as described hereinbefore.

Figure 1:
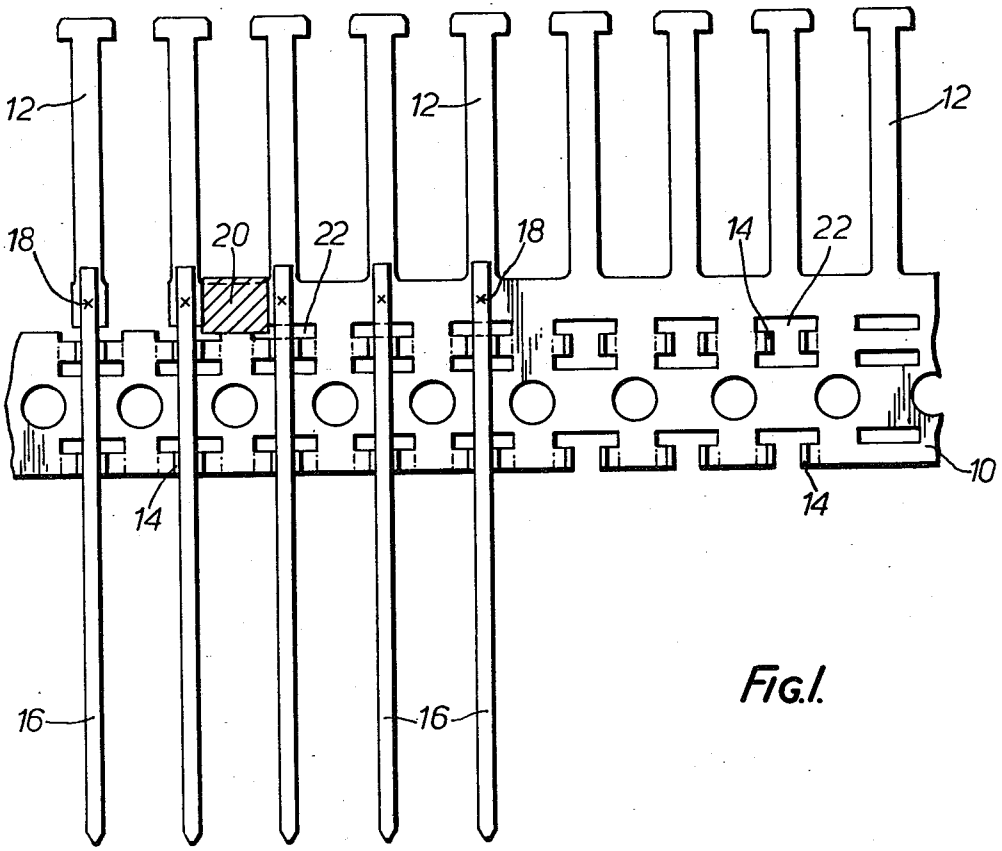
Figure 2:
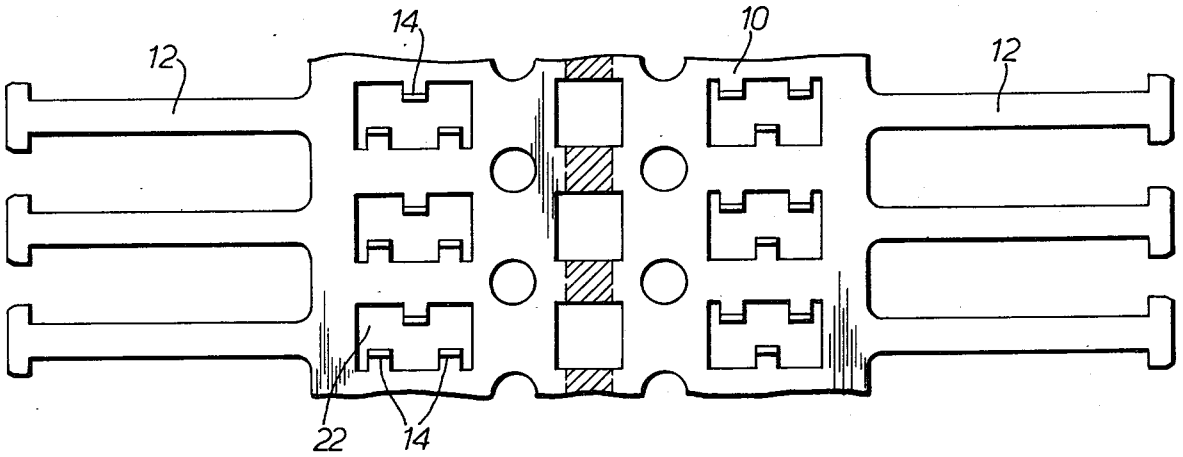

Embodiments of the invention will now be described by way of example only with reference to the accompanying drawings in which:

FIG. 1 illustrates a method of making electrical connectors according to the invention and FIG. 2 shows a portion of a modified carrier strip.

In FIG. 1 there is shown part of a carrier strip 10 which is formed by pressing. The strip includes a plurality of contact portions 12 extending at right angles to the longitudinal axis of the strip and a number of lugs 14 projecting perpendicularly from the strip. A portion of each of the strips is gold plated. The lugs 14 are formed in line with the contact portions 12 and in between these lugs are fed contact legs 16, one in line with each of the contact portions 12. The lugs 14 hold the contact legs 16 in contact with the carrier strips by friction.

Each contact leg 16 is then welded to the contact strip 10 at a spot 18 adjacent to the lower end of its respective contact portion 12.

A part 20 (shown cross-hatched in FIG. 1) of the carrier strip is now cut away between the contact portions 12, the part 20 reaching slots 22 formed in the carrier strip so that the contact portions are completely detached from the carrier strip 10. The carrier strip 10 now acts purely as a bandolier, supporting the contact legs 16 with the contact portions 12 welded to the ends of the contact legs 16. The connectors thus formed can then easily be removed from the bandolier and inserted into, for example, an electrical edge connector.

The lugs 14 and the slots 22 can be formed in the same pressing operation as the formation of the strip 10, or the lugs 14 can be formed immediately before the welding operation. Two pairs of lugs are shown formed on the carrier strip 10, but various other suitable arrangements may be used.

The contact legs 16 may be pushed lengthwise between the lugs 14 or fed over the strip 10 and forced down between the lugs. Similarly, the completed connectors may be removed by pushing the legs 16 lengthwise out from between the lugs 14 or pulling them upwards from the bandolier.

FIG. 2 shows a portion of a carrier strip 24 which is formed with contact portions extending at right angles from opposite sides of the strip. This strip is then parted along its central axis to produce two strips 10. A different arrangement of slots 22 and lugs 14 is also shown on FIG. 2 but the method of making the connectors is the same. In the embodiments described selected parts of the contact portions 12 may be plated, such as with gold, prior to the welding operation or prior to the parting operation.

Also in each case the welding operation may be carried out by spot welding one leg 16 at a time or a predetermined number of legs located on the carrier strip can be fed at a known speed under a weld head which is pulsed to coincide with the parts to be welded.

Alternatively the carrier strip can be fed continuously under a weld head which can be arranged to pulse continuously and at such a rate that at least one weld is made on each leg. Any suitable method of welding can be used.

As well as the legs 16 being retained on the carrier strip by the lugs described, additional external means of clamping and locating the legs to the strip can be arranged.

Either prior to welding or after welding and cropping, the legs 16 can be moveable axially on the bandolier so that subsequent processes such as swaging or forming the leg can be carried out.

What is claimed is:

1. A method of making electrical connectors, comprising the steps of:

producing an elongate planar strip, said elongate planar strip being shaped with a plurality of separate elongate contact portions extending outwardly at right angles with respect to one side of the longitudinal axis of said strip, said separate elongate portions being adapted to form electrical contact members, said strip also being formed with spaced apart lugs projecting perpendicularly from the plane of said strip and located in line with each of said separate elongate contact portions;

locating a plurality of rigid contact legs on said elongate planar strip, each contact leg being supported by said spaced apart lugs axially in line with one of said separate elongate contact portions, with one end being adjacent to the inner end of said elongate contact portion;

welding each said contact leg to said elongate planar strip at a spot adjacent to said one end; and severing each said elongate contact portion from said elongate planar strip;

whereby said elongate contact portion is retained on said contact leg by said weld, and said contact leg is retained on said elongate planar strip by said spaced apart lugs.

2. A method as claimed in claim 1, wherein said elongate planar strip comprises a plurality of elongate contact portions extending perpendicularly from both sides of said axis of said elongate planar strip, said elongate planar strip being separated into two strips along its central axis before said contact leg welding step.

3. A method as claimed in claim 1, wherein said elongate planar strip is formed by a pressing operation.

4. A method as claimed in claim 1, wherein said welding operation comprises spot welding one said contact leg at a time onto said elongate planar strip.

5. A method as claimed in claim 1, wherein a predetermined number of said contact legs located on said elongate planar strip are fed at a known speed under a weld head which is pulsed to coincide with the parts to be welded.

6. A method as claimed in claim 1, wherein said contact legs located on said elongate planar strip are fed continuously under said weld head which is pulsed continuously and at such a rate that at least one weld is made on each said leg.

* * * * *